US006039480A

United States Patent [19]

Andoh et al.

[11] Patent Number: 6,039,480

[45] Date of Patent: Mar. 21, 2000

[54] METHOD AND APPARATUS FOR FORMING TRANSFER IMAGES AND TRANSFER DRUM USED IN THE SAME

[75] Inventors: Tomio Andoh; Shiro Shibata; Tomoyuki Marugame, all of Tokyo, Japan

[73] Assignee: Toppan Printing Co., Ltd., Tokyo, Japan

[21] Appl. No.: 09/141,139

[22] Filed: Aug. 27, 1998

[30] Foreign Application Priority Data

Sep. 2, 1997 [JP] Japan ..... 9-236925

[51] Int. Cl.[7] ..... B41J 11/14

[52] U.S. Cl. ..... 400/662; 400/120.01

[58] Field of Search ..... 400/120.01, 648, 400/659, 661, 661.1, 661.4, 662; 346/103; 492/18, 45, 48, 49, 52, 56

[56] References Cited

U.S. PATENT DOCUMENTS 4,839,667 6/1989 Murakami et al. .
5,021,804 6/1991 Nozawa et al. .
5,123,151 6/1992 Uehara et al. ..... 355/282
5,168,289 12/1992 Katakabe et al. ..... 400/120
5,807,004 9/1998 Takei et al. ..... 400/661.1

FOREIGN PATENT DOCUMENTS 0 567 085 A2 10/1993 European Pat. Off. .
42 20 175 A1 12/1992 Germany .

*Primary Examiner*—Ren Yan
*Attorney, Agent, or Firm*—Armstrong, Westerman, Hattori, McLeland & Naughton

[57] ABSTRACT

In the present invention, the thermal efficiency and concentration of a thermal head on a transfer film over the surface of a transfer drum are improved, thereby improving the reproducibility of gradation in printing, which enables highly minute transfer images to be printed on the transfer film. This makes it possible to form a highly minute image on an image-transferred member. To do this, a cushion layer made of elastomer and a rigid layer with a surface finish of less than 2.0 $\mu$m on a surface of the cushion layer are provided on a surface of the drum base of the transfer drum.

16 Claims, 6 Drawing Sheets

METHOD AND APPARATUS FOR FORMING TRANSFER IMAGES AND TRANSFER DRUM USED IN THE SAME

BACKGROUND OF THE INVENTION

The present invention relates to a method and apparatus for forming transfer images in which an image printed by a thermal head and an ink ribbon on a image-reception layer formed on a transfer film in contact with the surface of a transfer drum is transferred together with the image-reception layer by the heating and pressurizing of the heat roller to an image-transferred member to form an image and to a transfer drum used in the apparatus, and more particularly to a transfer image forming method and apparatus capable of improving the thermal efficiency of a thermal head for a transfer film over the surface of the transfer drum and the reproducibility of gradation in printing and to a transfer drum used in the apparatus.

In general, a transfer image forming apparatus is an image forming apparatus that forms an image using dye or pigment as coloring material on an image-transferred member through a heating process or a heating and pressurizing process. Among such image forming apparatuses, one is based on an indirect transferring method in which an image using dye or pigment as coloring material is temporarily formed by causing the thermal head to thermally transfer the ink layer of an ink ribbon on the image-reception layer formed in a peelable manner on the transfer film serving as an intermediate recording medium, and thereafter the transfer film is heated and pressed against the image-transferred member with the heat roller so that the transfer image formed on the image-reception layer may be transferred together with the image-reception layer to the image-transferred member.

In one transfer image forming apparatus of this type, a buffer mechanism for removing the difference between the distance in the direction of the circumference of the rotating heat roller and the moving distance of the image-transferred member has been provided in a transfer mechanism, as in the transfer image forming apparatus disclosed in Japanese Patent Application No. 6-318003.

In another transfer image forming apparatus, there has been provided a burr removing mechanism that removes burrs in such a manner that burrs or foil fringes are prevented from appearing outside the image-reception layer on the image-transferred member when the image-reception layer on the transfer film is peeled and transferred from the substrate layer to the image-transferred member in transferring the image-reception layer on which the transfer image of the transfer film has been printed to the image-transferred member by heating and pressurization. Use of the mechanism enables the image-reception layer to be transferred sharply.

In one known image forming method with a transfer image forming apparatus, for example, in a thermal transfer method using thermal sublimation dye, a thermal transfer ribbon where thermal sublimation dye is coated over a base film and an image-transferred member to serve as a recording medium are stacked one on top of the other. On the basis of the image data prepared, the thermal transfer ribbon or the image-transferred member is selectively heated by the thermal head, thereby transferring and forming the desired image on the image-transferred member.

Typical image-transferred members used in such a method are card-like image-transferred members and booklet-like image-transferred members. The card-like image-transferred members include driver's licenses, identification cards, credit cards, bank cards, cash cards, employee identification cards, student identification cards, member's cards, chip card, smart card, contactless IC card, and optical cards. The booklet-like image-transferred members include bankbooks, passports, and visas.

The thermal transfer recording method using sublimation dye has disadvantages in that there are not many materials (dyeable materials) that can be dyed with sublimation dye. For example, the method can be applied only to image-transferred members composed of limited materials, such as polyester resin, acrylic resin, nylon resin, or vinyl chloride resin.

In spite of a desire to use materials other than the aforementioned ones, what has been proposed as means for thermal sublimation transfer recording using sublimation dye is as follows. In the image print section using a sublimation dye transfer ribbon and a thermal head, an image is first printed onto a dyeable material layer (e.g., a dyeable resin layer or a dyeable adhesion layer) on a transfer film serving as an intermediate recording medium where the dyeable material layer is stacked on a base film (a first recording), as disclosed in, for example, Jpn. Pat. Appln. KOKAI Publication 63-81093. Then, in the transfer section, the image on the dyeable material layer of the transfer film is heated and pressed together with the dyeable material layer against the image-transferred member by means of the pressure drum, thereby transferring the image onto the image-transferred member (a second recording).

As for the transfer film, an intermediate recording medium, serving as an important technical element in the indirect transfer method including the first recording and second recording, one example of the basic stacked structure is composed of a base film, such as polyethylene terephthalate, a protective layer with an image protecting function, an image-reception/adhesion layer having the function of receiving an image and the function of causing the image to adhere to an image-transferred member, and a peeling layer provided so as to peel off between the base film and the protective layer. The image is formed on the image-reception layer/adhesion layer. In the second recording, the image-reception layer/adhesion layer, together with the protective layer, is peeled from the base film and transferred onto the surface of the image-transferred member.

While the image-reception layer/adhesion layer has been included in the layer structure, an image-reception layer with no adhesion to the image-transferred member may be used, depending on the material used. In such a case, the image is formed on the image-reception layer and can be transferred or stuck by providing an adhesion layer made of adhesive material on the image-reception layer or the surface of the image-transferred member, by sticking a film made of adhesive material on the image-reception layer, or by heating and pressurizing the transfer film and the image-transferred member with a film made of adhesive material sandwiched between the surface of the image-transferred member and the image-reception layer.

In the second recording, the transfer film on which the image has been formed and the image-transferred member are aligned with each other and heated and pressurized, thereby causing the image together with the image-reception/adhesion layer and the protective layer to adhere to the image-transferred member. At that time, the transfer film and image-transferred member are separated in the apparatus, whereas the image-reception/adhesion layer and protective layer carrying the image on the transfer film in the heated and pressured area is separated at the peeling layer section from the base of the transfer film and transferred to the image-transferred member. The transfer area on the image-transferred member is generally set according to specifications, taking into account the security, durability, and design of the image-transferred member.

The aforementioned conventional transfer image forming apparatus has generally a transfer drum and prints images on the thin-film image-reception layer stacked on the transfer film in contact with the surface of the transfer drum by means of its thermal head and an ink ribbon. The characteristics of the surface of the transfer drum has a significant effect on the reproducibility of gradation of the transfer image printed by the thermal head on the transfer film.

BRIEF SUMMARY OF THE INVENTION

Accordingly, it is an object of the present invention to provide a technique for forming a highly minute image with a good reproducibility of gradation by improving the surface of the transfer drum in the transfer image forming apparatus to achieve a cushion of the ink ribbon and transfer film in contact with the surface of the transfer drum against the thermal head and a highly accurate point contact of the ink ribbon and transfer film with the thermal head.

According to one aspect of the present invention, there is provided a transfer image forming method comprising the steps of: providing a cushion layer on a surface of a drum base of a transfer drum and a rigid layer with a surface finish of less than 2.0 $\mu$m on a surface of the cushion layer; printing a transfer image on a transfer film in contact with a surface of the transfer drum by use of a thermal head and an ink ribbon; and transferring the transfer image to a specific position on an image-transferred member fixed on a stage by causing a heat roller to heat and press the transfer film over the image-transferred member against the stage and relatively moving the stage and heat roller in a longitudinal direction of the transfer film.

In the method, it is desirable that the ink ribbon should be made of a thermal transfer recording material which includes 30 to 70 parts by weight of pigment and 25 to 60 parts by weight of amorphous high polymer organic substance whose softening point is 40° C. to 150° C. and has a virtually transparent thermal ink layer whose thickness is in the range from 0.2 $\mu$m to 1.0 $\mu$m, the particle diameter of 70% of the pigment in the thermal ink layer being 1.0 $\mu$m or less and the reflection density of the transfer image being 1.0 or more on a white support.

In the method, it is desirable that the cushion layer should be made of elastometric material with a layer thickness of 1.0 to 10 mm.

In the method, it is desirable that the rigid layer should be made of rigid synthetic resin material with a layer thickness of 100 to 1000 $\mu$m other than elastometric material.

In the method, it is desirable that the rigid layer should be made of synthetic resin material.

According to another aspect of the present invention, there is provided a transfer image forming apparatus comprising: a transfer drum having a cushion layer provided on a surface of a drum base and a rigid layer with a surface finish of less than 2.0 $\mu$m provided on a surface of the cushion layer; a thermal head for printing a transfer image on a transfer film in contact with a surface of the transfer drum via an ink ribbon; a stage for supporting and fixing an image-transferred member; and a heat roller for heating and pressing the transfer film over the image-transferred member against the stage, wherein the stage and the heat roller relatively move in a longitudinal direction of the transfer film.

In the apparatus, it is desirable that the cushion layer should be made of elastometric material with a layer thickness of 1.0 to 10 mm.

In the apparatus, it is desirable that the rigid layer should be made of rigid synthetic resin material with a layer thickness of 100 to 1000 $\mu$m other than elastometric material.

In the apparatus, it is desirable that the rigid layer should be made of synthetic resin material.

According to another aspect of the present invention, there is provided a transfer drum for use in a transfer image forming apparatus which causes a thermal head and an ink ribbon to print a transfer image on a transfer film in contact with a surface of the transfer drum and transfers the transfer image to a specific position on an image-transferred member, the transfer drum comprising: a drum base; a cushion layer provided on a surface of the drum base; and a rigid layer with a surface finish of less than 2.0 $\mu$m provided on a surface of the cushion layer.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention in which.

DETAILED DESCRIPTION OF THE INVENTION

Hereinafter, referring to the accompanying drawings, embodiments of the present invention will be explained.

Figure 1:
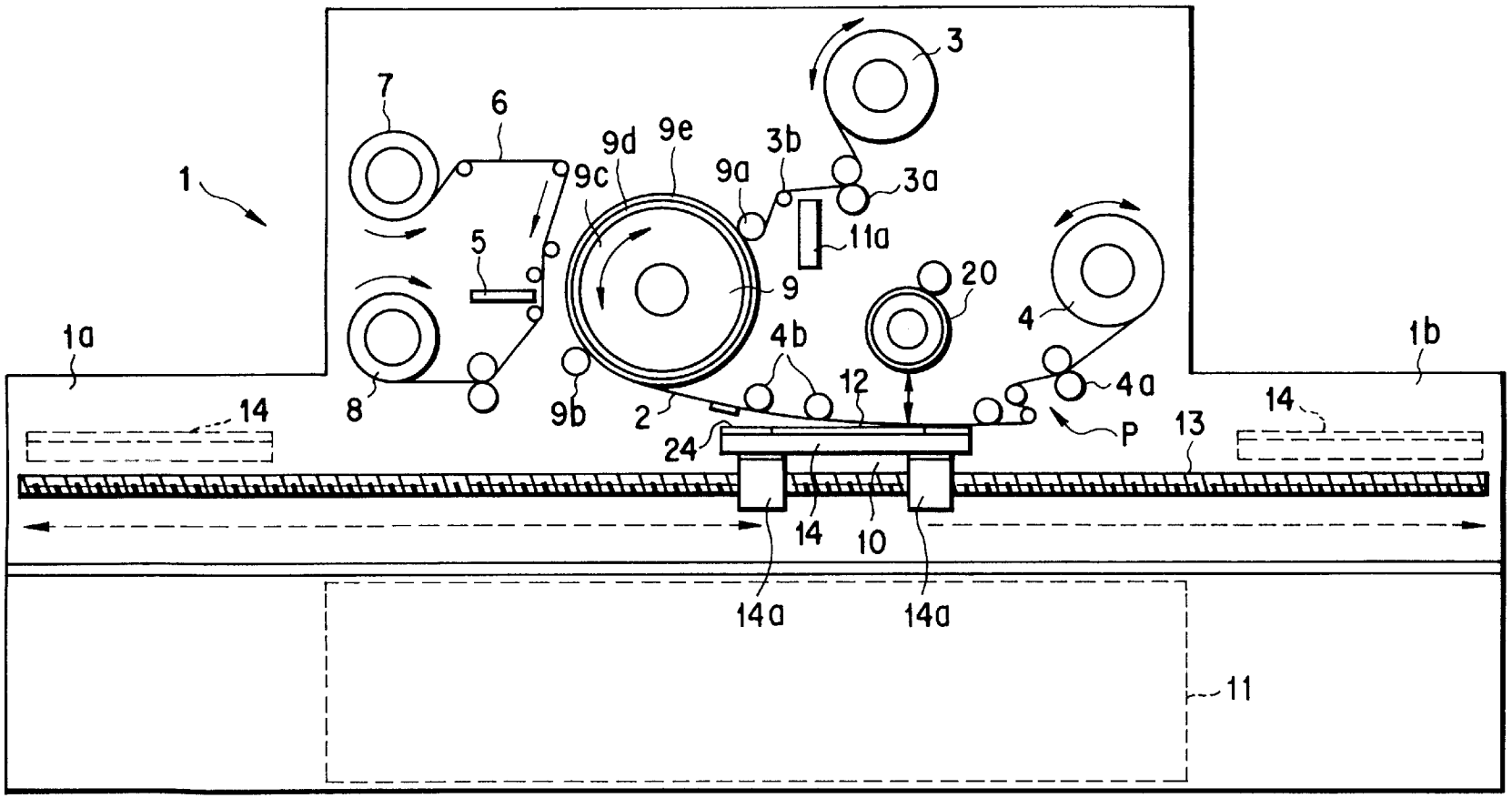
FIG. 1 is an overall side view of a transfer image forming apparatus according to the present invention.

FIG. 1 is a schematic overall side view of a transfer image forming apparatus 1 according to the present invention.

The transfer image forming apparatus 1 comprises a supply reel 3 and a take-up reel 4 for a transfer film 2 serving as an intermediate recording medium, a thermal head 5, an ink ribbon 6 (thermal sublimation ink ribbon or heat melt ink ribbon) having a yellow, magenta, cyan, and black sublimation or heat melt ink layer to transfer sublimation ink or heat melt (heat adhesion) ink, including one melted by heat softening, to the transfer film 2, a supply reel 7 and a take-up reel 8 for the ink ribbon 6, a transfer drum 9, a transfer mechanism 10, and a control unit 11.

The rotation axis of each of the supply reel 3, the take-up reel 4, pinch rollers 3*a*, 4*a*, the transfer drum 9, rollers 9*a*, 9*b*, the supply reel 7 and take-up reel 8 for the ink ribbon 6 is connected via a magnetic clutch to a motor acting as a power source. They are rotated by the turning on and off of the magnetic clutch under the control of the control unit 11 (a microprocessor or a programmable controller) or by the noncontacting and contacting (the release and application of the nip pressure) of each pinch roller effected by the on and off action of a plunger.

While in the embodiment, a booklet 12 is used as a transfer object (or an image-transferred member), it may be a single sheet member. When the ink ribbon 6 used is a sublimation ink ribbon, vinyl chloride resin, polyethylene terephthalate, polyamide resin (nylon), acrylic resin, a copolymer of vinyl chloride and vinyl acetate, ABS resin, resin dyeable to such sublimation dye as polybutyl terephthalate, or a paper or metal base sheet coated with these resins may be used. When the ink ribbon 6 used is a heat melt ink ribbon, the transfer object (image-transferred member) is not limited as long as it is made of a material that allows the adhesion of the heat melt ink.

The inventors of this application have found that use of a specific material for the ink ribbon has enabled the present invention to produce a notable effect. Specifically, it is desirable that the ink ribbon 6 should be made of a thermal transfer recording material which includes 30 to 70 parts by weight of pigment and 25 to 60 parts by weight of amorphous high polymer organic substance whose softening point is 40° C. to 150° C. and has a virtually transparent thermal ink layer whose thickness is in the range from 0.2 $\mu$m to 1.0 $\mu$m, the particle diameter of 70% of the pigment in the thermal ink layer being 1.0 $\mu$m or less and the reflection density of the transferred image being 1.0 or more on a white support. The details of the thermal transfer recording material has been disclosed in Jpn. Pat. Appln. KOKAI Publication 7-117359 (corresponding to European Patent No. 649,754, U.S. Pat. No. 5,726,698, and Canadian Patent No. 2,134,063).

In the transfer image forming apparatus 1, the transfer film 2 fed from the supply reel 3 is wound around the take-up reel 4 via a pinch roller 3*a*, a guide roller 3*b*, a pinch roller 4*a*, guide rollers 4*b*, 4*c*. The transfer film 2 can not only move in one direction toward the take-up reel 4 between the supply reel 3 and the take-up reel 4 but also move back and forth, as the need arises. The film 2 is supported by the transfer drum 9 capable of rotating in synchronization with the one-direction motion or the reciprocating motion of the transfer film 2.

The transfer film 2 on the transfer film 9 is in contact with the surface of the rotating transfer drum 9 and advances at the same speed as the rotation speed. Rollers 9*a*, 9*b* capable of coming into contact with and separating from the transfer drum 9 fix the transfer film 2 to the transfer drum 9. When the printing of the ink ribbon 6 is disabled, the rollers 9*a*, 9*b* release the transfer film 2. When the thermal head 5 prints with the ink ribbon 6, the rollers 9*a*, 9*b* fix the transfer film 2.

Reference symbol 11*a* indicates an optical sensor for sensing a print sense mark on the transfer film 2. The advance amount of the transfer film 2 found by sensing the sense mark with the sensor 11*a* is sent to the control unit 11. The transfer image on the transfer film 2 is formed on the adhesion layer so as to correspond to the transport distance from when the sensor has sensed the sense mark until the transfer mechanism 10 peels the transfer film. The sense mark of the transfer image is provided at a specific position on the transfer film 2.

A print sense mark is printed at the same time that the transfer image is printed. The distance between the transfer image and the sense mark is constant. When the sense mark sensing signal has been received, the transfer film is transported by a specific distance to the position in which the image is to be transferred.

When the start section of an image formation area on the transfer film 2 has reached the tip of the thermal head 5, the supply reel 7 sends the ink ribbon 6 to the take-up reel 8. The thermal head 5 transfers the image via the ink ribbon 6 to the transfer film 2 on the transfer drum 9. The transfer mechanism 10 causes a heat roller 20 to transfer the image on the surface of the transfer film 2 subjected to the printing process to a booklet 12, an image-transferred member.

As shown in FIG. 1, the transfer drum 9 is used for the thermal head 5 to transfer the image via the ink ribbon 6 to the transfer film 2. The transfer drum 9 is provided in such a manner that it faces the thermal head 5 with a space between them. In the transfer drum 9, the outer surface of a metal (e.g., steel or aluminum) drum base 9*c* is lined with a cushion layer 9*d* (an elastic layer) of a specific thickness. A rigid layer 9*e* is provided on the surface of the cushion layer 9*d*.

The cushion layer 9*d* has a thickness of 1.0 to 10 mm, preferably 3.5 to 6 mm. It is desirable that the cushion layer should be made of an about 5-mm-thick elastomeric material, such as ethylene propylene rubber (EPR, EPM), ethylene propylene diene methylene rubber (EPDM), or silicone rubber. The rigid layer 9*e* is made of a synthetic resin material other than elastomeric material which is more rigid than the cushion layer 9*d* and has a thickness of, for example, 100 to 1000 $\mu$m, preferably 200 to 450 $\mu$m. It is desirable that the rigid layer 9*e* should be made of an about 300 $\mu$m-thick synthetic resin material, such as tetrafluoroethylene-perfluoroalkyl vinyl ether copolymer, polyimide, polyamide-imide copolymer, polyether ketone, polyethylene naphthalate, or polyethylene terephthalate. The rigid layer 9*e* is polished to a surface finish (Rz) of less than 2.0 $\mu$m, preferably less than 1.0 $\mu$m. If the rigid layer 9*e* were made of metal material produced by, for example, stainless electroforming, heat from the thermal head 5 would escape to the rigid layer 9*e* side, making it harder for the ink layer of the ink ribbon 6 to melt and soften. To avoid this problem, the rigid layer 9*e* is made of synthetic resin material.

Because the surface of the transfer drum 9 is composed of the elastic inner layer of the cushion layer 9*d* and the rigid outermost surface layer of the rigid layer 9*e*, the surface of the drum 9 has a cushion against the thermal head 5. In addition, for example, when the thickness of the ink layer of the ink ribbon 6 is less than 1 μm and printing is done on the transfer film 2 by an indirect transfer method, the surface of the rigid layer 9*e* causes the heater section of the thermal head 5 to come into point-contact with the transfer film 2 with high accuracy, achieving a very good thermal efficiency, which improves the heat concentration, leading to a good reproducibility of gradation in printing. If the surface finish (Rz) exceeded 2.0 μm, irregularities in the surface would appear on the image. Because the rigid layer 9*e* has a fine surface finish (Rz) of less than 2.0 μm, a highly minute transfer image can be printed on the transfer film 2.

Figure 2:
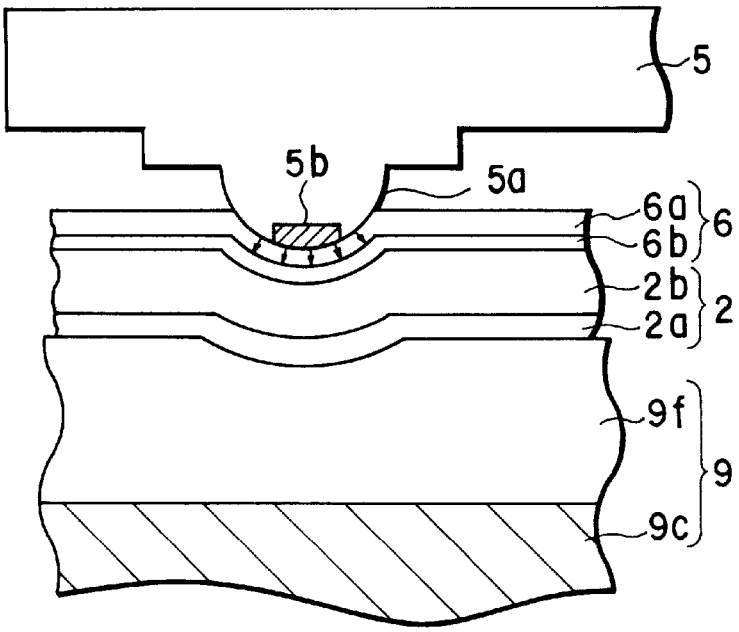
FIG. 2 is a partially enlarged front view of the thermal head and transfer drum in a general transfer image forming apparatus.
Figure 3:
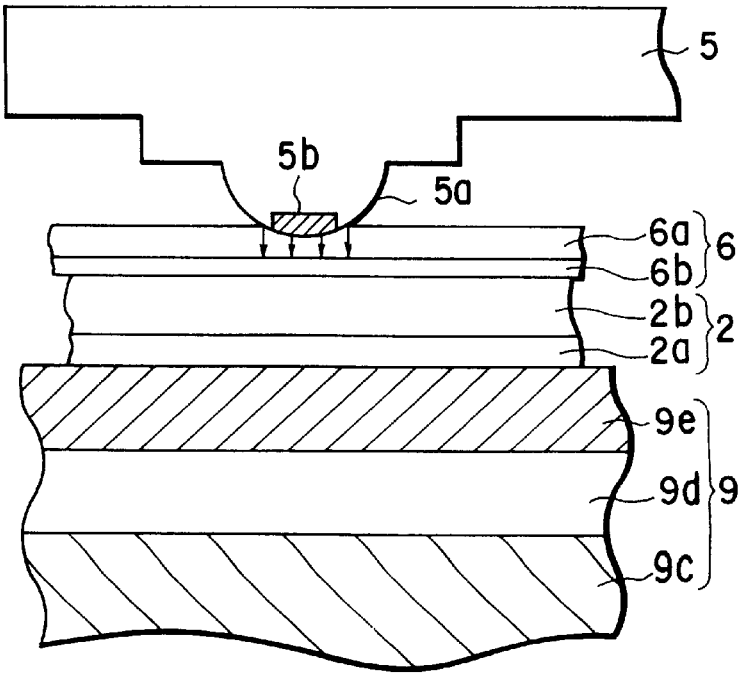
FIG. 3 is a partially enlarged front view of the thermal head and transfer drum in the transfer image forming apparatus of the present invention.

FIG. 2 is a partially enlarged front sectional view to help explain a state where the ink ribbon 6 and transfer film 2 are caused to intervene between the thermal head 5 and the transfer drum 9 in a conventional transfer image forming apparatus and the transfer image is printed on the transfer film 2. FIG. 3 is a partially enlarged front sectional view to help explain a state where the ink ribbon 6 and transfer film 2 are caused to intervene between the thermal head 5 and the transfer drum 9 in the transfer image forming apparatus of the present invention and the transfer image is printed on the transfer film 2.

The transfer film 2 is a film in which an image-reception layer 2*b* is stacked on a base film layer 2*a* in a peelable manner. The ink ribbon 6 has an ink layer 6*b* of a given color stacked on a base film 6*a* in a peelable manner by heat melt and heat softening.

In the conventional transfer drum 9 of FIG. 2, the surface of a metal drum base 9*c* is lined with a cushion layer 9*f* made of elastomer. When the thermal head 5 prints the transfer image on the transfer film 2, printing can be done even if the surface finish of the transfer drum 9 is relatively rough. In spite of this merit, a projected glaze section 5*a* with a smooth face provided on the thermal head 5 presses the cushion layer 9*f* of the transfer drum 9 from the ink ribbon 6 side, which causes the heating element 5*b* at the tip of the glaze section 5*a* to sink in the transfer film 2.

As a result, the heat from the heating element 5*b* (its unit pixel size: for example, 40 $\mu m^2$ to 150 $\mu m^2$) does not concentrate on the ink ribbon 6 and transfer film 2 but disperses around, preventing the temperature rise area from being formed only in the area corresponding to the size of the heating element 5*b*. This permits a temperature rise to occur in an area larger than the size of the heating element 5*b*, resulting in the formation of a blurred transfer image not faithful to the shape of the pixel of the heating element 5*b*. Particularly when a bright image is formed at the highlight section, the problem is liable to arise.

In the transfer drum 9 of the present invention shown in FIG. 3, the surface of the metal drum base 9*c* is lined with a cushion layer 9*d* made of elastomer. The rigid layer 9*e* is placed on the surface of the cushion layer 9*d*. When the thermal head 5 prints the transfer image on the transfer film 2, even if a projected glaze section 5*a* with a smooth face provided on the thermal head 5 presses the cushion layer 9*d* of the transfer drum 9 from the ink ribbon 6 side, the heating element 5*b* at the tip of the glaze section 5*a* will not sink in the transfer film 2 because of the existence of the rigid layer 9*e*. This allows the cushion layer 9*d* to have a suitable elasticity and the heat from the heating element 5*b* (its unit pixel size: for example, 40 $\mu m^2$ to 150 $\mu m^2$) to concentrate on the ink ribbon 6 and transfer film 2, which enables the formation of a temperature rise area only in the area corresponding to the size of the heading element 5*b*. As a result, a sharp transfer image faithful to the shape of the pixel of the heating element 5*b* can be formed. Particularly when a bright image is formed at the highlight section, a good print can be produced.

As described above, when the transfer drum 9 is provided with the rigid layer 9*e*, consideration should be given to the surface finish of the rigid layer 9*e*.

When the surface finish (Rz) of the rigid layer 9*e* has exceeded 2.0 μm, irregularities in the surface never fail to appear as noise in the printed image. To avoid this problem, the surface finish (Rz) of the rigid layer 9*e* of the invention is made as smooth as possible, or less than 2.0 μm, preferably less than 1.0 μm. This removes image noise caused by the surface finish of the rigid layer 9*e*, enabling the formation of a highly minute printed image.

The pressure of the thermal head 5 varies greatly according to the specification for the recording medium used. For example, the thermal head is used at a suitable pressure in the range from about 1.0 to 3.0 kgf/cm. The pressure range need not be absolutely fulfilled, because the suitable pressure may be different, depending on the specification for the recording medium used.

Some concrete examples will be given in the following cases:

(a) thermal transfer recording with an ink ribbon as disclosed in U.S. Pat. No. 5,726,698, (b) ordinary heat-melt thermal transfer recording with an ink ribbon whose coloring material transfer layer is rich with low-melting point wax or of resin thermal transfer recording with an ink ribbon whose coloring material transfer layer is rich with heat melt resin, and (c) thermal sublimation transfer recording with an ink ribbon whose coloring material transfer layer is chiefly composed of sublimation dye serving as coloring material and a binder material for holding the coloring material.

It is desirable that the thermal head should be used at a suitable pressure in each of the respective pressure ranges by linear load in the direction of main scanning:

(a) about 1.0 to 2.4 kgf/cm.

(b) about 2.0 to 3.0 kgf/cm.

(c) about 1.8 to 2.8 kgf/cm.

The transfer mechanism 10 is provided with a stage 14, which clamps the image-transferred member 12, such as a booklet, in place and, in a transfer operation, is moved by a timing belt or a feed screw shaft 13 along a specific linear guide at the same speed as that of the transfer film 2 in one direction toward the take-up reel 4 for the transfer film 2. The stage 14 moves from the supply side 1*a* of the image-transferred member 12 and, after the completion of the transfer operation, moves to the outlet section 1*b* or returns to the original position on the supply side 1*a*.

The image-transferred member 12 is placed on the stage 14 of the transfer mechanism 10. The image-transferred member 12 is fixed on the stage 14 in such a manner that a fixing plate 24 is laid on areas other than the transfer area of the image-transferred member 12 and pressed and clamped in place. The details will be given later.

The operation of the transfer image forming apparatus 1 will be explained briefly. In the initial operation, the transfer film 2 is pulled out of the supply reel 3, passes through the pinch roller 3*a*, guide roller 3*b*, transfer drum 9, guide roller 4*b*, transfer mechanism 10, guide roller 4*c*, and pinch roller 4*a*, and is wound around the take-up reel 4. The ink ribbon 6 is pulled out of the supply reel 7, passes through the thermal head 5, and is wound around the take-up reel 8. The thermal head 5 is separated away from the transfer drum 9.

What are shot by photographing means, such as a one-shot camera or a video camera are used as image data used for transfer images. The image data previously recorded on a recording medium may be used.

The data necessary for printing, including the determination, interval, transfer color, and printing range of the transfer image, and the contents of print have been stored in a host computer (not shown) beforehand. When the main switch has been turned on, the initialization of the control unit 11 is completed. At this time, the supply reel 3, take-up reel 4, and pinch rollers 3*a*, 4*a* have been unclutched and stopped. Furthermore, the thermal head 5 is separated from the transfer drum 9, the supply reel 7 and take-up reel 8 are out of operation, and the stage 14 of the transfer mechanism 10 stands still on the inlet 1*a* side for a booklet 12.

The booklet 12 is fixed on the stage 14 of the transfer mechanism 10 on the supply side 1*a* of the image-transferred member 12. Under the control of the host computer, each magnetic clutch is turned on and off and each pinch roller is pressed and released by the turning on and off of each plunger. This causes the supply reel 3, take-up reel 4, and pinch rollers 3*a*, 4*a* to rotate or stop and the stage 14 of the transfer mechanism 10 to move to a specific position and stop there.

When a sense mark has been sensed by the sensor 11*a*, the printing range for the transfer image is advanced to a specific position of the transfer drum 9, where the rollers 9*a*, 9*b* are pressed against the transfer drum 9 to fix the transfer film 2 in place. The transfer drum 9 is rotated toward the take-up reel 4. The reels 7, 8 are rotated to cause a specific ink layer of the ink ribbon 6 to be positioned in front of the thermal head. Then, the thermal head 5 is pressed against the transfer drum 9 and prints the transfer image to the surface of the image-reception layer of the transfer film 2.

When printing is done in more than one color with the ink ribbon 6, the thermal head 5 is retreated from the transfer drum 9 with the rollers 9*a*, 9*b* in contact with the transfer drum 9. Then, the ink ribbon 6 is fed and the operation of rotating the transfer drum 9 toward the reel 4 is repeated. The one-direction rotating operation or reciprocating rotating operation of the transfer drum 9 is carried out according to the number of pulses to a stepping motor. In the stepping motor for driving the transfer drum 9, a damper (not shown) for improving the accuracy of position is provided on the motor shaft, which reduces unwanted vibration.

After the four colors have been printed, the rollers 9*a*, 9*b* are released from the transfer drum 9, the thermal head 5 is separated from the transfer drum 9, and the ink ribbon 6 is advanced until the first one of the new four colors have come in front of the thermal head 5 and then is stopped.

The transfer film 2 on which the transfer image have been printed is transported by a specific amount from the supply reel 3 toward the reel 4. At the transfer mechanism 10, transfer is effected with the booklet 12 facing the transfer image. In the transfer mechanism 10, the heating and pressurization of the heat roller 20 causes the transfer image at the surface of the image-reception layer of the transfer film 2 to be transferred to the booklet 12 with the image-reception layer as a surface protective layer.

After the transfer image and image-reception layer have been transferred to the booklet 12, a peeling roller P separates the transfer film 2 into the image-reception layer carrying the transfer image and the base sheet. The base sheet is wound around the take-up reel 4.

Figures 4A, 4B:
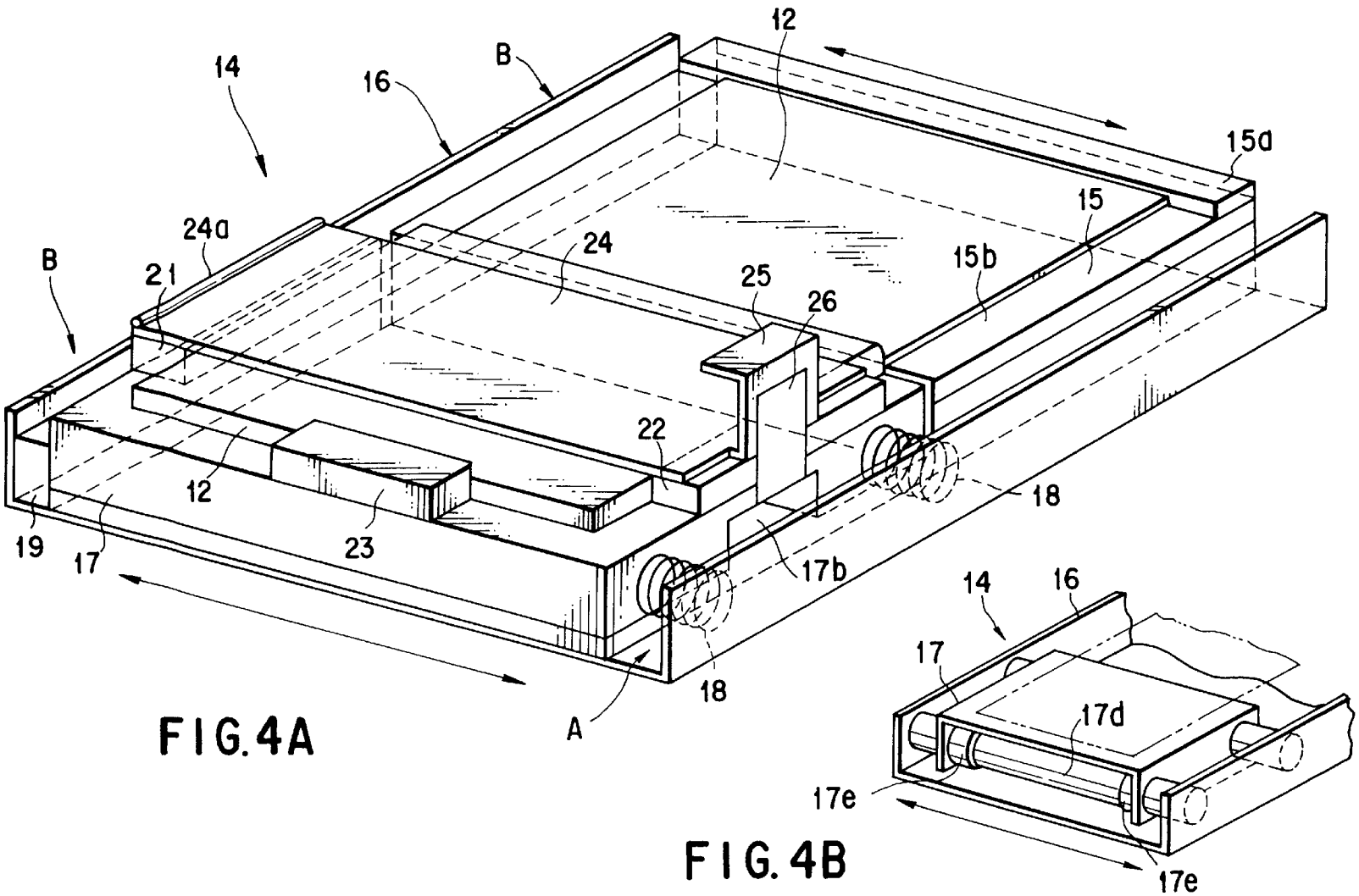
FIGS. 4A and 4B are perspective views of a first example of the stage in the transfer image forming apparatus of the present invention.

One example of the configuration of the stage 14 in the transfer mechanism 10 will be explained in detail. As shown in FIG. 4A, a first example of the stage 14 is composed of a fixing base 15 whose front, rear, and bottom are held by a housing 16 and which functions as a transfer press base board and a slide base 17 which supports one end of the image-transferred member 12 and holds it in place.

The fixing base 15 is secured to the housing 16. The slide base 17 is provided in such a manner that it can make a slight back-and-forth horizontal movement within the housing 16.

The housing 16 shown in FIG. 4A has a nut section 14*a* screwed on a feed screw shaft 13 shown in FIG. 1 on its undersurface and moves as the feed screw shaft 13 rotates. Alternately, the housing 16 is provided integrally to an endless timing belt or to both ends of the timing belt and moves in the direction of the arrow (back and forth) as timing pulleys over which the timing belt is stretched rotate.

As shown in FIG. 4A, on the top surface of the outer end of the fixing base 15, a straight stay 15*a* at least whose surface is made of synthetic resin and has a specific thickness is provided in the direction of motion. The top surface of the stay 15*a* is made higher than the transfer surface of the image-transferred member 12. In the case where the outer end of the image-transferred member 12, such as an edge section corresponding to the outer end of the booklet, is straight, it is favorable that the inner end of the stay 15*a* is straight to press against the outer end of the booklet.

Furthermore, on the top surface of the fixing base 15, a heat-resistant base rubber 15*b* (e.g., silicone rubber) is provided. A heat-resistant base rubber subjected to a non-adhesive process may be used as the base rubber 15*b*. The surface of the base rubber 15*b* may be ground with a grinder into an irregular surface, which helps hold the image-transferred member 12 suitably on the surface of the fixing base 15 and allows the member 12 to slide when a specific stress is applied to the image-transferred member 12 in the direction of slide. Moreover, the irregularities prevent the image-transferred member 12, the booklet, from adhering to the base rubber 15*b*.

The top surface of the stay 15*a* and that of the base rubber 15*b* may have the same surface smoothness. It is desirable that the top surface of the stay 15*a* should be less smooth.

The booklet 12 (the image-transferred member) is installed on the top surface of the base rubber 15*b* on the fixing base 15 in such a manner that the outer end of the booklet is pressed against the inner end of the stay 15*a*. The booklet 12 acting as the image-transferred member may be, for example, a passport or a bankbook.

The transfer film 2 is fed above the booklet 12 on the top surface of the base rubber 15*b* and above the stay 15*a*. The transfer film 2 is advanced in the direction in which the housing 16 moves. The slide base 17 acting as image-transferred member supporting means provided near the fixing base 15 is designed to make slight movement toward the housing 16 in the direction in which the transfer film 2 moves. The slide base 17 has a groove 17*b* made in its undersurface and moves along a linear guide composed of a projection (not shown) on the housing 16. The linear guide may be a shaft-like guide bar 17*d* and a plain bearing 17*e* as shown in FIG. 4B.

As shown in FIG. 4A, positioning blocks 21, 22, 23 for the image-transferred member are provided at the front, rear, and side ends of the top surface of the slide base 17. A fixing plate 24 is connected via a hinge 24*a* in such a manner that it can open and close. A stop fitting 25 is provided at the open end of the fixing plate 24. In the stop fitting 25, an engaging hole is made. The projection of a stop spring 26 at the front of the slide base 17 engages with the engaging hole, thereby locking the open end side of the fixing plate 26 that fastens the end of the image-transferred member 12.

Figure 5:
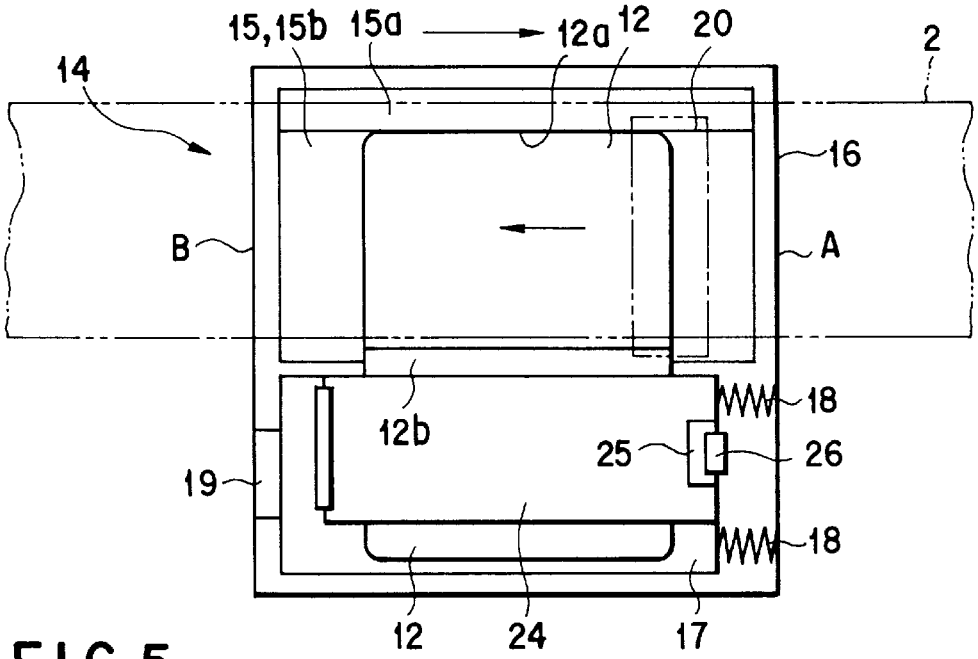
FIG. 5 is a plan view of the first example of the stage in the transfer image forming apparatus of the present invention.
Figure 6:
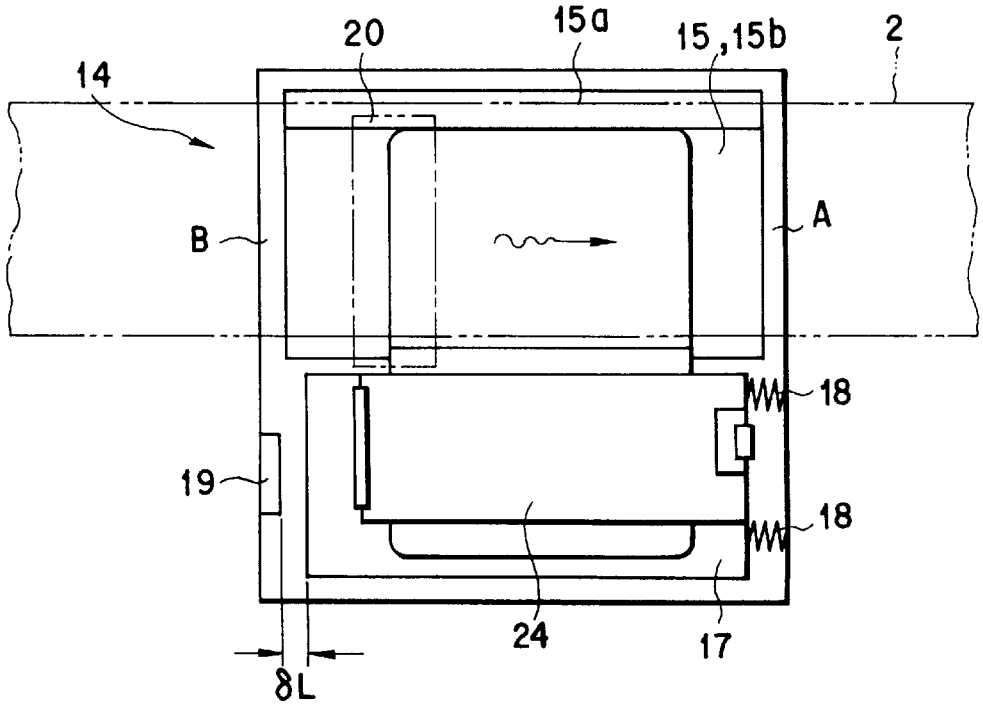
FIG. 6 is a plan view of the first example of the stage in the transfer image forming apparatus of the present invention.

As shown in FIGS. 4A, 5, and 6, a pair of coil springs 18 acting as elastic members is provided at the front of the slide base 17. Instead of the coil springs, plate springs, synthetic rubber, or sponge may be used as the elastic members. Use of elastomer, such as synthetic rubber, as the elastic member has the merit of being free from the vibration of springs. Neither the coil spring 18 nor elastomer have necessary to be used alone. Both members may be used in series or in parallel to effectively alleviate a shock to the booklet 12.

A stopper 19 is provided at the rear of the slide base 17. The slide base 17 is urged by an elastic member 18 so that the base may be always in contact with the stopper 19. In another configuration of the stage 14 of the transfer mechanism 10, all of the base area from the present fixing base 15 to the slide base 17 may be made a new fixing base 15 and a clamp mechanism, such as the fixing plate 24, for securing the image-transferred member 12 be provided at one end of the fixing base 15.

A heat roller 20 can move up and down with respect to the base rubber 15*b*. The heat roller 20 has a cylindrical aluminum core (not shown) with a diameter of about 50 mm. A 50-$\mu$m-thick coating layer of a copolimer of tetrafluoroethylene and perfluoroalkyl vinyl ether is provided on the surface of the heat roller 20. Inside the heat roller 20, a 1-mm-thick heated vulcalnized silicone rubber layer is provided on the aluminum core via a primer layer. Inside the aluminum core of the heat roller 20, a halogen lamp heater is provided as a heat source. The inside of the aluminum core is blackened with black paint. The heat roller 20 is temperature-controlled by a temperature sensor and a temperature controller (both not shown). Its surface temperature is kept at about 150° C. to 180° C., preferably about 170° C.

In the embodiment, the heat roller 20 moves up and down, causing the stage 14 carrying the image-transferred member 12 to move. The stage 14, image-transferred member 12, and transfer film 2 may be fixed in specific positions and only the heat roller 20 be moved up and down and rotated in the direction of the arrow. Furthermore, both of the heat roller 20 and transfer film 2 and the stage 14 and image-transferred member 12 may be moved.

In a constant position, the heat roller 20 comes into contact with and separates from the fixing base 15 and stay 15*a*, with the transfer film 2 between them. In the embodiment, as shown in FIG. 5, the heat roller 20 moves while pressing the transfer film 2 against the fixing base 15 and stay 15*a* of the stage 14 driven. The roller 20 first comes into contact with the front A of the fixing base 15 and rotates toward the rear B while being in contact with the base 15 as shown in FIG. 4A. While in the embodiment, the driving system is provided on the stage 14 side, it may be provided on the heat roller 20 side.

As shown in FIG. 6, when the heat roller 20 heats and pressurizes the transfer film 2 and image-transferred member 12, nip pressure is produced. In addition, the relative movement of the heat roller 20 and booklet 12 causes the image-transferred member 12 to contract or shift in the direction in which the heat roller 20 rotates. A slight movement of the slide base 17 holding the image-transferred member 12, however, causes the position of the transfer image printed on the transfer film 2 to coincide with the transfer position of the image-transferred member 12 acceptably.

The image-transferred member 12 generally has variations in thickness. The thickness of the member 12 may be intentionally varied to form a watermark. In this case, use of a rubber layer on or near the contact surface of the heat roller 20 equalizes pressurization. In a case where an image by a holographic grid has been contained in the transfer film 2 beforehand and is transferred together with the adhesion layer to the image-transferred member 12, equalized pressurization prevents the holographic grid from being destroyed, which enables a good transfer image to be formed on the image-transferred member 12.

Next, the transfer operation of the transfer image forming apparatus 1 of the present invention will be explained in detail by reference to FIGS. 5 and 6.

In FIG. 5, with the image-transferred member 12 fixed to the fixing base 15 of the stage 14 and the heat roller 20 sandwiching the transfer film 2 between them with a specific pressure (a nip pressure), when the stage 14 moves from left to right (in the direction of the arrow), the heat roller 20 moves relatively in the opposite direction.

The transfer film 2 is guided in such a manner that, as shown in FIG. 5, the outer end 12*a* of the image-transferred member 12 (the edge section in the case of the booklet) is coated completely and the inner end of the image-transferred member 12 is coated up to a specific position. In the case of the booklet 12, the transfer film 2 is guided in such a manner that the portion from the edge section 12*a* to the gutter section 12*b* is coated or the portion from the edge section 12*a* up to a suitable position on a single page excluding the gutter section 12*b* is coated. At that time, one end of the heat roller 20 presses against at least the top surface of the stay 15*a* and the other end presses the inner end of the transfer film 2 completely.

For example, in a case where the fixing base 15 and heat roller 20 have hard surfaces with no cushion, the stage 14 moves by a linear distance of L in a one-dimensional pattern of line contact with a very small nip width, and the heat roller 20 with a radius of R rotates by a rotational central angle of θ1 simultaneously, the relationship between the contact circular are length K1 (rotational contact distance), the linear distance L, and the rotational central angle θ1 when the periphery of the heat roller 20 comes into linear contact while rotating is as follows:

Since a general formula for radian is central angle θ=circular angle K/radius R of circular arc (unit:rad), this gives $$\theta 1 = K1/R$$

$$K1 = R \times \theta 1$$

Because of the one-dimensional pattern of line contact, K1=L or K1≈L

Because the length T1 in the direction of transfer in the transfer area of the transfer film 2 and the image-transferred member 12 in pressure contact by the fixing base 15 and heat roller 20 corresponds to the length of the rotational contact circular are of the heat roller 20, this gives:

$$T1 = K1 = L$$

or $$T1 = K1L$$

In the embodiment, however, because the base rubber 15*b* with a cushion is provided on the fixing base 15 of the stage 14 and the heat roller 20 rotates while pressing against the base rubber 15, the heat roller 20 rotates while the periphery of the heat roller 20 keeps in plane contact with the surface of the base rubber 15*b* of the fixing base 15 in a two-dimensional pattern plane with a large nip width.

As described above, with the heat roller 20 in plane contact with the base rubber 15*b* of the fixing base 15 with a cushion, when the stage 14 moves by a linear distance of L and simultaneously the heat roller 20 with a radius of R rotates by a rotational central angle of θ1, the contact circular are length K2 (rotational contact distance), the linear distance L, and the rotational central angle θ when the periphery of the heat roller 20 comes into plane contact while rotating will be explained.

First, the relationship between the contact circular are length δK with which the periphery of the heat roller 20 is in plane contact and the central angle δθ of the circular are is as follows:

Since a general formula for radian is central angle θ=circular angle K/radius R of circular arc (unit: rad), this gives $$\delta\theta = K/R$$

$$\delta K = R \times \delta\theta$$

Even in the case of movement by plane contact, as long as the base rubber 15*b* does not slip relative to the heat roller 20 at their interface, the heat roller 20 with a radius of R rotates by a rotational central angle of θ1 as in the case of line contact, when the stage 14 has moved by a linear distance of L. As a result, the contact circular arc length K2 with which the heat roller 20 comes into plane contact is:

$$K2 = K1 + \delta k$$

Because the length T2 in the direction of transfer in the transfer area of the transfer film 2 and image-transferred member 12 through pressure contact by the fixing base 15 and heat roller 20 corresponds to the length of the rotational contact circular are of the heat roller 20, this gives:

$$T2 = K2 = L + \delta K$$

or $$T2 = K2L + \delta K$$

$$K = K2 - L$$

The amount of shift δL is:

$$\delta L = K2 - L$$

During the time from when the transfer operation through pressure contact by the fixing base 15 and heat roller 20 has been completed until the heat roller 20 has separated from the fixing base 15, the restoring force of the silicone rubber 15*b* causes the image-transferred member 12 to move by the contact circular arc length δK, the amount of shift δL by plane contact for the moving distance L of the stage 14, in the direction in which the stage 14 moves.

As described above, when the stage 14 in linear motion and the heat roller 20 in rotary motion effect heating and pressurization via the image-transferred member 12 and the transfer film 2 on the member 12, the peripheral surface of the heat roller 20 forms a circular arc surface of the base rubber 15*b* because of the presence of a nip width. After the transfer operation, when the heat roller 20 separates from the fixing base 15, restoring force temporarily develops in the base rubber 15*b* and image-transferred member 12 (the transfer section of the booklet) to make them return to the original flat state. While fixing the image-transferred member 12 to the slide base 17, the restoring force makes extruding force that instantaneously extrudes the image-transferred member 12 by the amount of shift δL almost equal to δK with respect to the fixing base 15, surpassing the elasticity of the elastic member 18. To make the image-transferred member 12 slide smoothly over the surface of the fixing base 15 when the member 12 is pushed, the base rubber 15*b* may be lubricated.

With the transfer image forming apparatus of the present invention, the transfer film 2 is directed to the surface of the image-transferred member 12 and the top surface of the stay 15*a* a little higher in position than the image-transferred member 12 and heated by the heat roller 20. As a result, when the image-reception layer carrying the transfer image has been transferred to the image-transferred member 12 and the heat roller 20 starts to separate upward to release the pressure contact, the image-transferred member 12 has been extruded by only the amount of shift δL and moves forward. In this case, the transfer film 2 on the top surface of the stay 15*a* has been pressed and fixed by the heat roller 20. Therefore, the image-reception layer transferred to the image-transferred member 12 side is cut off sharply at the boundary line between the inner end of the stay 15*a* and the outer end (the edge section 12*a* of the booklet 12) of the image-transferred member 12.

Figure 7:
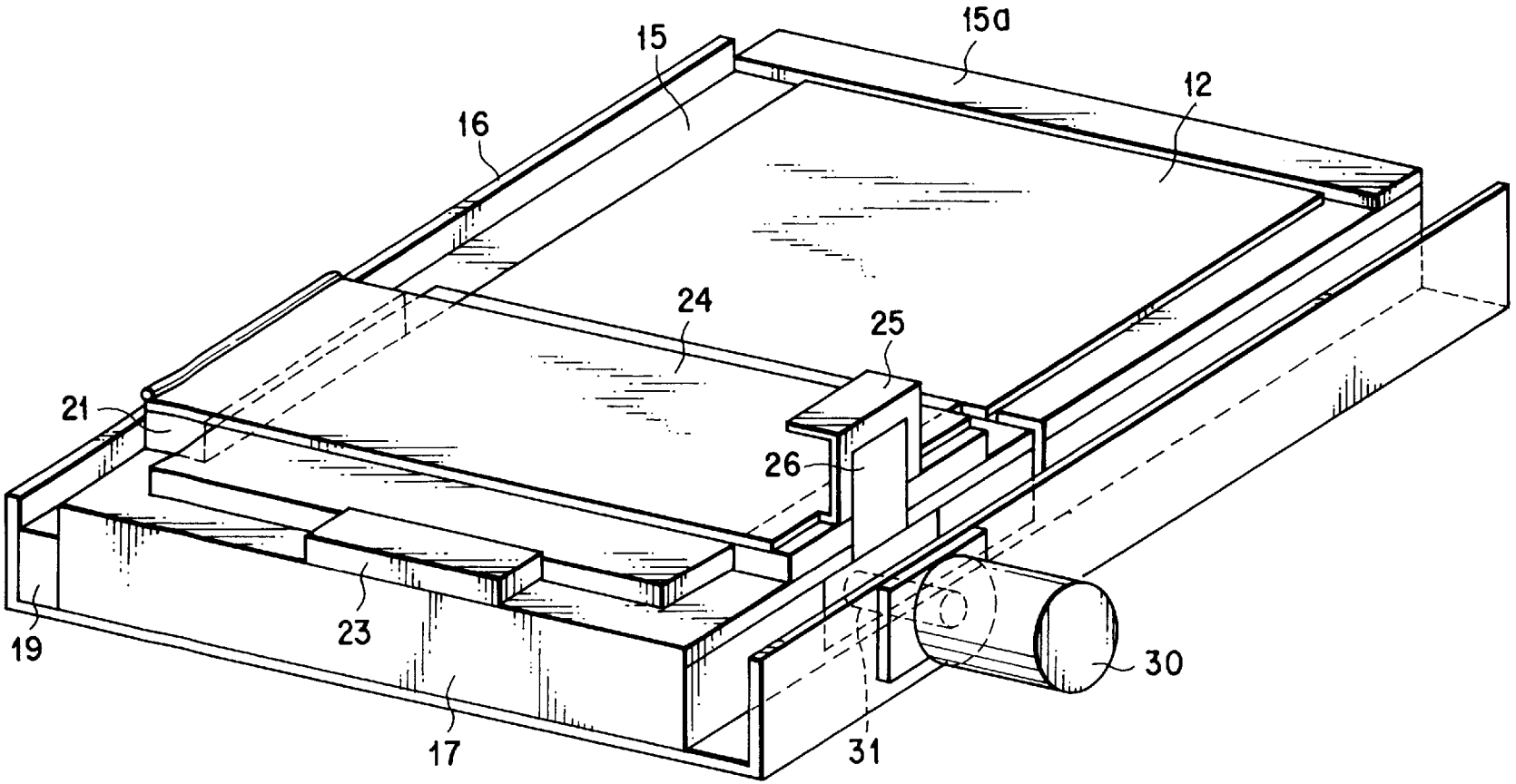
FIG. 7 is a plan view of a second example of the stage in the transfer image forming apparatus of the present invention.
Figure 8:
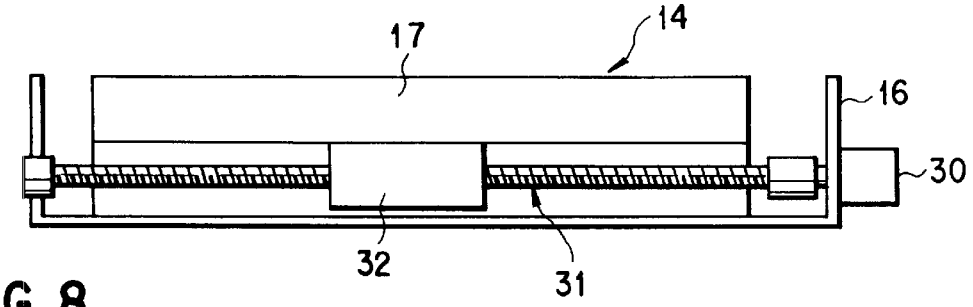
FIG. 8 is a side view of the second example of the stage in the transfer image forming apparatus of the present invention.

FIGS. 7 and 8 show a second example of the stage 14 in the transfer image forming apparatus of the present invention. In the second example, instead of the coil springs 18, 18, a pulse motor 30 is provided on the base 17 and a feed screw 31 is screwed with the nut section 32 of the slide base 17. The control unit 11 controls the direction of rotation and the number of revolutions of the pulse motor 30. When the housing 16 starts to move, the pulse motor 30 moves the slide base 17 by the previously calculated amount of shift of the slide base 17. Because the remaining configuration is the same as described above, its explanation will not be given.

Figure 9:
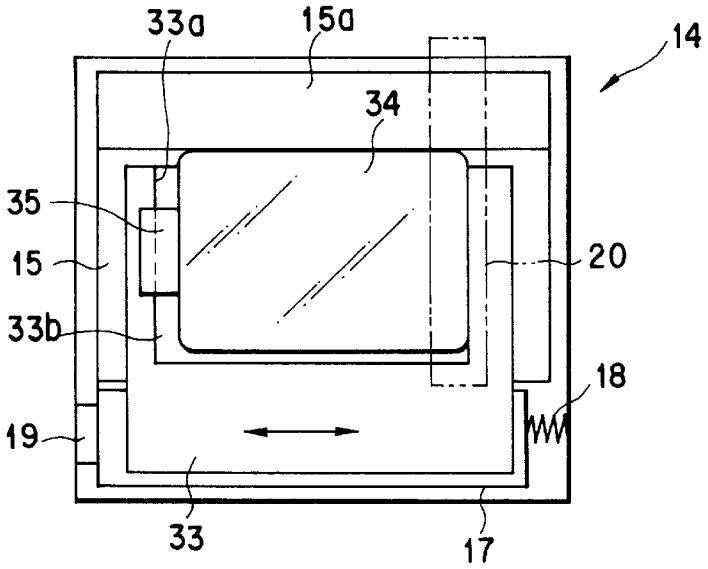
FIG. 9 is a plan view of a third example of the stage in the transfer image forming apparatus of the present invention.

FIG. 9 shows a third example of the stage 14 in the transfer image forming apparatus of the present invention. In the third example, an auxiliary slide base 33 is provided on the top surface of the fixing base 14 and that of the slide base 17. The auxiliary slide base 33 is secured to the top surface of the slide base 17 and designed to be sliceable over the top surface of the fixing base 14.

In the auxiliary slide base 33, a rectangular recessed section 33*a* is made from the outer end toward the inside. The recessed section 33*a* is for fixing a flat-sheet image-transferred member 12, such as a plastic card 34, differing in structure from a booklet, and is less deep than the thickness of the card 34. In the recessed section 33*a*, a base rubber 33*b* is provided. A clamp projection 35 with a top surface lower than the top surface of the card 34 is provided on either the front or the rear of the stage 14 in the direction of travel or on both of them. One end of the card 34 is pressed horizontally to cause the opposite end of the card to press against the inner end of the recessed section 33*a* or the other clamp projection 35, thereby holding the plastic card 34 in place. The clamp projection 35 may be L-shaped in a plan view.

The slide base 17 and auxiliary slide base 33 are designed to be movable in the back-and-forth direction of the stage 14. They are actuated by the coil spring 18 toward the stopper 19 side. At the beginning of heating and pressurization, the heat roller 20 is located to the right of the stage 14 as shown in FIG. 9 and performs a transfer operation while rotating to the left side as the stage 14 moves to the right in FIG. 9. At this time, as in the first and second embodiments, the slide base 17 and auxiliary slide base 33 are extruded to the right in FIG. 9, surpassing the coil spring 18. Then, the restoring force of the base rubber 15*b* causes the slide base 17 and auxiliary slide base 33 to move by the contact circular arc length δK in plane contact for the moving distance L of the stage 14 in the direction in which the stage 14 moves, which absorbs the amount of shift δL.

Figure 10:
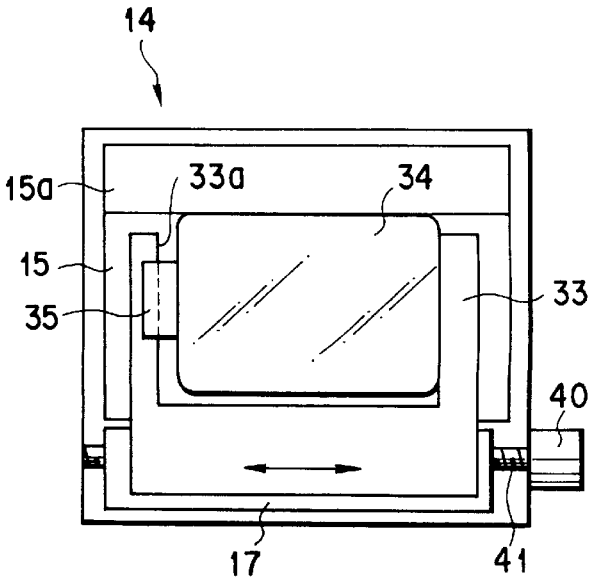
FIG. 10 is a plan view of a fourth example of the stage in the transfer image forming apparatus of the present invention.

FIG. 10 shows a fourth example of the stage 14 in the transfer image forming apparatus of the present invention. In the fourth example, as in the second example, a pulse motor 40 and a feed screw 41 fixed on the shaft of the pulse motor 40 are provided on the stage 14 side and a nut section (not shown) is provided on the undersurface of the slide base 17. The slide base 17 of the stage 14 and the clamp structure are the same as those in the third example, so explanation of them will not be given.

As described in detail, with the transfer image forming apparatus of the present invention, the elastic inner layer made of a cushion layer and the rigid outermost surface layer made of a rigid layer are provided on the peripheral face of the transfer drum facing the thermal head via the ink ribbon and transfer film. This not only provides a cushion against the thermal head but also enables the thermal head to come into point contact with the transfer film with high accuracy. As a result, the thermal efficiency becomes very high, achieving an improved thermal concentration and a good reproducibility of gradation in printing to the transfer film, which enables the formation of images on the transfer film with a good reproducibility of gradation.

The effect of the present invention is remarkable especially when a specific material is used as the ink ribbon. Specifically, it is desirable that the ink ribbon should be made of a thermal transfer recording material which includes 30 to 70 parts by weight of pigment and 25 to 60 parts by weight of amorphous high polymer organic substance whose softening point is 40° C. to 150° C. and has a virtually transparent thermal ink layer whose thickness is in the range from 0.2 μm to 1.0 μm, the particle diameter of 70% of the pigment in the thermal ink layer being 1.0 μm or less and the reflection density of the transferred image being 1.0 or more on a white support.

Because the rigid layer on the outer surface of the transfer drum that comes into direct contact with the transfer film has a very fine surface finish, it can print a highly minute transfer image on the transfer film. As a result, an image with a good reproducibility of gradation can be formed on the image-transferred member. The rigid layer is effective in forming transfer images not only on such booklets as bankbooks or passports but also such cards as driver's licenses, identification cards, credit cards, bank cards, cash cards, employee identification cards, student identification cards, member's cards and optical cards, and such papers as bills and securities.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A transfer drum for use in a transfer image forming apparatus which causes a thermal head and an ink ribbon to print a transfer image on a transfer film in contact with a surface of the transfer drum and transfers the transfer image to a specific position on an image-transferred member, said transfer drum comprising:

a drum base;

a cushion layer provided on a surface of said drum base; and a rigid layer with a surface finish of less than 2.0 μm provided on a surface of said cushion layer.

2. A transfer image forming method comprising the steps of:

providing a cushion layer on a surface of a drum base of a transfer drum and a rigid layer with a surface finish of less than 2.0 μm on a surface of the cushion layer;

printing a transfer image on a transfer film in contact with a surface of said transfer drum by use of a thermal head and an ink ribbon; and transferring the transfer image to a specific position on an image-transferred member fixed on a stage by causing a heat roller to heat and press said transfer film over the image-transferred member against the stage and relatively moving the stage and heat roller in a longitudinal direction of the transfer film.

3. A transfer image forming method according to claim 2, wherein said ink ribbon is made of a thermal transfer recording material which includes 30 to 70 parts by weight of pigment and 25 to 60 parts by weight of amorphous high polymer organic substance whose softening point is 40° C. to 150° C. and has a virtually transparent thermal ink layer whose thickness is in the range from 0.2 μm to 1.0 μm, the particle diameter of 70% of the pigment in the thermal ink layer being 1.0 μm or less and the reflection density of the transfer image being 1.0 or more on a white support.

4. A transfer image forming method according to claim 3, wherein said cushion layer is made of elastometric material with a layer thickness of 1.0 to 10 mm.

5. A transfer image forming method according to claim 4, wherein said rigid layer is made of rigid synthetic resin material with a layer thickness of 100 to 1000 μm other than elastometric material.

6. A transfer image forming method according to claim 4, wherein said rigid layer is made of synthetic resin material.

7. A transfer image forming method according to claim 3, wherein said rigid layer is made of synthetic resin material.

8. A transfer image forming method according to claim 3, wherein said rigid layer is made of rigid synthetic resin material with a layer thickness of 100 to 1000 μm other than elastometric material.

9. A transfer image forming method according to claim 8, wherein said rigid layer is made of synthetic resin material.

10. A transfer image forming apparatus comprising:

a transfer drum having a cushion layer provided on a surface of a drum base and a rigid layer with a surface finish of less than 2.0 μm provided on a surface of the cushion layer;

a thermal head for printing a transfer image on a transfer film in contact with a surface of said transfer drum via an ink ribbon;

a stage for supporting and fixing an image-transferred member; and a heat roller for heating and pressing said transfer film over said image-transferred member against the stage, wherein said stage and said heat roller relatively move in a longitudinal direction of the transfer film.

11. A transfer image forming apparatus according to claim 10, wherein said cushion layer is made of elastometric material with a layer thickness of 1.0 to 10 mm.

12. A transfer image forming apparatus according to claim 11, wherein said rigid layer is made of rigid synthetic resin material with a layer thickness of 100 to 1000 $\mu$m other than elastometric material.

13. A transfer image forming apparatus according to claim 11, wherein said rigid layer is made of synthetic resin material.

14. A transfer image forming apparatus according to claim 10, wherein said rigid layer is made of rigid synthetic resin material with a layer thickness of 100 to 1000 $\mu$m other than elastometric material.

15. A transfer image forming apparatus according to claim 11, wherein said rigid layer is made of synthetic resin material.

16. A transfer image forming apparatus according to claim 10, wherein said rigid layer is made of synthetic resin material.

* * * * *